US010894695B2

(12) United States Patent
Billard et al.

(10) Patent No.: US 10,894,695 B2
(45) Date of Patent: Jan. 19, 2021

(54) DEVICE AND METHOD FOR ACTUATING AN ELEVATOR SAFETY BRAKE

(71) Applicant: Otis Elevator Company, Farmington, CT (US)

(72) Inventors: Justin Billard, Amston, CT (US); Daryl J. Marvin, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 72 days.

(21) Appl. No.: 15/749,038

(22) PCT Filed: Aug. 2, 2016

(86) PCT No.: PCT/US2016/045153
§ 371 (c)(1),
(2) Date: Jan. 30, 2018

(87) PCT Pub. No.: WO2017/023926
PCT Pub. Date: Feb. 9, 2017

(65) Prior Publication Data

US 2018/0222717 A1 Aug. 9, 2018

Related U.S. Application Data

(60) Provisional application No. 62/200,907, filed on Aug. 4, 2015.

(51) Int. Cl.
*B66B 5/18* (2006.01)
*B66B 5/04* (2006.01)

(52) U.S. Cl.
CPC . *B66B 5/18* (2013.01); *B66B 5/04* (2013.01)

(58) Field of Classification Search
CPC ..... B66B 5/18; B66B 5/04
See application file for complete search history.

(56) References Cited

U.S. PATENT DOCUMENTS 6,161,653 A 12/2000 Skalski et al.
6,173,813 B1 1/2001 Rebillard et al.
(Continued)

FOREIGN PATENT DOCUMENTS

EP 1439144 A2 7/2004
EP 1832542 B1 9/2007
(Continued)

OTHER PUBLICATIONS

PCT ISR Written Opinion; International Application No. PCT/US2016/045153; International Filing Date: Aug. 2, 2016, dated Nov. 2, 2016, pp. 1-5.
(Continued)

*Primary Examiner* — Michael A Riegelman
(74) *Attorney, Agent, or Firm* — Cantor Colburn LLP

(57) ABSTRACT

A safety device configured to aid in braking movement of a hoisted object is provided including a mounting frame. A brake block is connected to the mounting frame and is operably coupled to a safety brake. An inner block assembly is disposed between the mounting frame and the brake block. The inner block assembly is movable relative to both the mounting frame and the brake block. Upon detection of a predetermined condition, the brake block is configured to engage and adjacent guide member to actuate the safety brake.

17 Claims, 11 Drawing Sheets

(56) References Cited

U.S. PATENT DOCUMENTS

| | | | | |
|---|---|---|---|---|
| 6,176,350 | B1 * | 1/2001 | Schlosser | B66B 5/20 187/359 |
| 7,267,201 | B2 | 9/2007 | Ito | |
| 7,299,898 | B2 * | 11/2007 | Husmann | B66B 5/20 187/373 |
| 7,398,863 | B2 | 7/2008 | Liebetrau et al. | |
| 7,575,099 | B2 | 8/2009 | Oh et al. | |
| 7,650,969 | B2 * | 1/2010 | Monzon | B66B 5/0068 187/300 |
| 7,721,852 | B2 | 5/2010 | Ishioka et al. | |
| 8,186,483 | B2 | 5/2012 | Sirigu et al. | |
| 9,027,714 | B2 | 5/2015 | Husmann et al. | |
| 9,120,643 | B2 * | 9/2015 | Meierhans | B66B 5/20 |
| 9,663,327 | B2 | 5/2017 | Terry et al. | |
| 2012/0152663 | A1 * | 6/2012 | Legeret | B66B 5/20 187/404 |
| 2014/0008157 | A1 | 1/2014 | Terry et al. | |
| 2014/0158476 | A1 * | 6/2014 | Wei | B66B 5/22 188/65.1 |
| 2014/0224594 | A1 | 8/2014 | Billard et al. | |
| 2016/0200549 | A1 * | 7/2016 | Billard | B66B 5/22 188/65.1 |
| 2017/0001835 | A1 * | 1/2017 | Hu | B66B 5/18 |
| 2017/0129741 | A1 * | 5/2017 | Hu | F16D 59/02 |
| 2017/0283216 | A1 * | 10/2017 | Marvin | B66B 5/0031 |
| 2017/0283217 | A1 * | 10/2017 | Marvin | B66B 5/0031 |
| 2017/0291797 | A1 * | 10/2017 | Hu | B66B 5/0031 |
| 2018/0222717 | A1 * | 8/2018 | Billard | B66B 5/18 |
| 2018/0222718 | A1 * | 8/2018 | Khzouz | B66B 5/18 |
| 2018/0327224 | A1 * | 11/2018 | Billard | B66B 9/00 |
| 2018/0354749 | A1 * | 12/2018 | Fauconnet | B66B 5/044 |
| 2019/0186573 | A1 * | 6/2019 | Manes | F16F 1/187 |

FOREIGN PATENT DOCUMENTS

| | | | |
|---|---|---|---|
| JP | 4890246 | B2 | 3/2012 |
| JP | 2013018645 | A | 1/2013 |
| JP | 2013133183 | A | 7/2013 |
| JP | 2014508698 | A | 4/2014 |
| WO | 0037348 | A1 | 6/2000 |
| WO | 2006070436 | A1 | 7/2006 |
| WO | 2012128758 | A1 | 9/2012 |
| WO | 2014077811 | A1 | 5/2014 |
| WO | 2014200122 | A1 | 12/2014 |

OTHER PUBLICATIONS

PCT Notification of Transmittal of the International Search Report; International Application No. PCT/US2016/045153; International Filing Date: Aug. 2, 2016, dated Nov. 2, 2016, pp. 1-5.

European Office Action; International Application No. 16750344.0-1017; International Filing Date: Mar. 2, 2018; dated Dec. 19, 2019; 3 pages.

Indian Office Action; International Application No. 201817003512; International Filing Date: Jan. 30, 2018; dated Jun. 17, 2020; 5 pages.

Japanese Office Action; International Application No. 2018-505598; International Filing Date: Feb. 2, 2018; dated Sep. 11, 2020; 7 pages.

* cited by examiner

DEVICE AND METHOD FOR ACTUATING AN ELEVATOR SAFETY BRAKE

CROSS REFERENCE TO RELATED APPLICATIONS

This application is a National Stage application of PCT/US2016/045153, filed Aug. 2, 2016, which claims the benefit of U.S. Provisional Application No. 62/200,907, filed Aug. 4, 2015, both of which are incorporated by reference in their entirety herein.

BACKGROUND

Embodiments of this present disclosure generally relate to elevator systems, and more particularly, to a braking device of an elevator system that is operable to aid in braking a hoisted object relative to a guide member.

Hoisting systems (e.g. elevator systems, crane systems) often include a hoisted object, such as an elevator car, a counterweight, a tension member (i.e. a rope or belt) that connects the hoisted object and the counterweight, and a sheave that contacts the tension member. During operation of such hoisting systems, the sheave may be driven (e.g. by a machine) to selectively move the hoisted object and the counterweight. Hoisting systems often include braking devices that aid in braking (i.e. slowing and/or stopping movement of) the hoisted object relative to a guide member, such as a rail or wire for example. Aspects of the present disclosure are directed to an improved braking device.

SUMMARY

According to an exemplary embodiment of the present disclosure, a safety device configured to aid in braking movement of a hoisted object is provided including a mounting frame. A brake block is connected to the mounting frame and is operably coupled to a safety brake. An inner block assembly is disposed between the mounting frame and the brake block. The inner block assembly is movable relative to both the mounting frame and the brake block. Upon detection of a predetermined condition, the brake block is configured to engage and adjacent guide member to actuate the safety brake.

In addition to one or more of the features described above, or as an alternative, in further embodiments the safety device is mounted to the hoisted object.

In addition to one or more of the features described above, or as an alternative, in further embodiments a brake pad is arranged at a portion of the brake block configured to engage the guide member.

In addition to one or more of the features described above, or as an alternative, in further embodiments a linkage extends between the brake block and the safety brake.

In addition to one or more of the features described above, or as an alternative, in further embodiments friction generated between the brake block and the guide member causes the brake block to apply a force to the linkage to actuate the safety brake.

In addition to one or more of the features described above, or as an alternative, in further embodiments upon detection of the predetermined condition, the brake block is biased by at least one biasing mechanism towards the guide member.

In addition to one or more of the features described above, or as an alternative, in further embodiments the at least one biasing mechanism biases the brake block laterally.

In addition to one or more of the features described above, or as an alternative, in further embodiments the at least one biasing mechanism biases the inner block assembly and the brake block towards the guide member.

In addition to one or more of the features described above, or as an alternative, in further embodiments an electromagnetic latch is housed within mounting frame. The electromagnetic latch is configured to attract a magnetic portion of the inner block assembly.

In addition to one or more of the features described above, or as an alternative, in further embodiments upon detection of the predetermined condition, the inner block assembly is configured to decouple from the electromagnetic latch.

In addition to one or more of the features described above, or as an alternative, in further embodiments the inner block assembly includes a first surface and the brake block includes a second surface. The first surface and the second surface are generally complementary and arranged in overlapping contact during normal movement of the hoisted object.

In addition to one or more of the features described above, or as an alternative, in further embodiments upon engagement with the guide member, the brake block is configured to move vertically relative to the mounting frame.

In addition to one or more of the features described above, or as an alternative, in further embodiments sliding engagement between the first surface and the second surface after detection of the predetermined condition is configured to drive the inner block assembly laterally towards the mounting frame.

In addition to one or more of the features described above, or as an alternative, in further embodiments a second biasing mechanism extends between the inner block assembly and the brake block. The second biasing mechanism being configured to move the brake block such that the first surface and the second surface are aligned.

According to another embodiment, a method of actuating a safety brake of an elevator system is provided including detecting an over-speed condition and moving a portion of a safety device into engagement with the guide member. The safety device includes a mounting frame, a brake block, and an inner block assembly disposed between and movable relative to both the mounting frame and the brake block. The brake block is operably coupled to the safety brake. A force is applied to the safety brake such that the safety brake engages the guide member.

In addition to one or more of the features described above, or as an alternative, in further embodiments engagement between the portion of the safety device and the guide member causes the brake block to move vertically.

In addition to one or more of the features described above, or as an alternative, in further embodiments vertical movement of the brake block applies the force to the safety brake.

In addition to one or more of the features described above, or as an alternative, in further embodiments the safety device includes an electromagnetic latch and the brake block moves into engagement with the guide member upon application of an electrical current to the electromagnetic latch.

In addition to one or more of the features described above, or as an alternative, in further embodiments further comprising resetting the safety device.

BRIEF DESCRIPTION OF THE DRAWINGS

The foregoing and other features, and advantages of the present disclosure are described in the following detailed description taken in conjunction with the accompanying drawings in which.

The detailed description of the present disclosure describes exemplary embodiments of the present disclosure, together with some of the advantages and features thereof, by way of example with reference to the drawings.

DETAILED DESCRIPTION OF THE PRESENT DISCLOSURE

Figure 1:
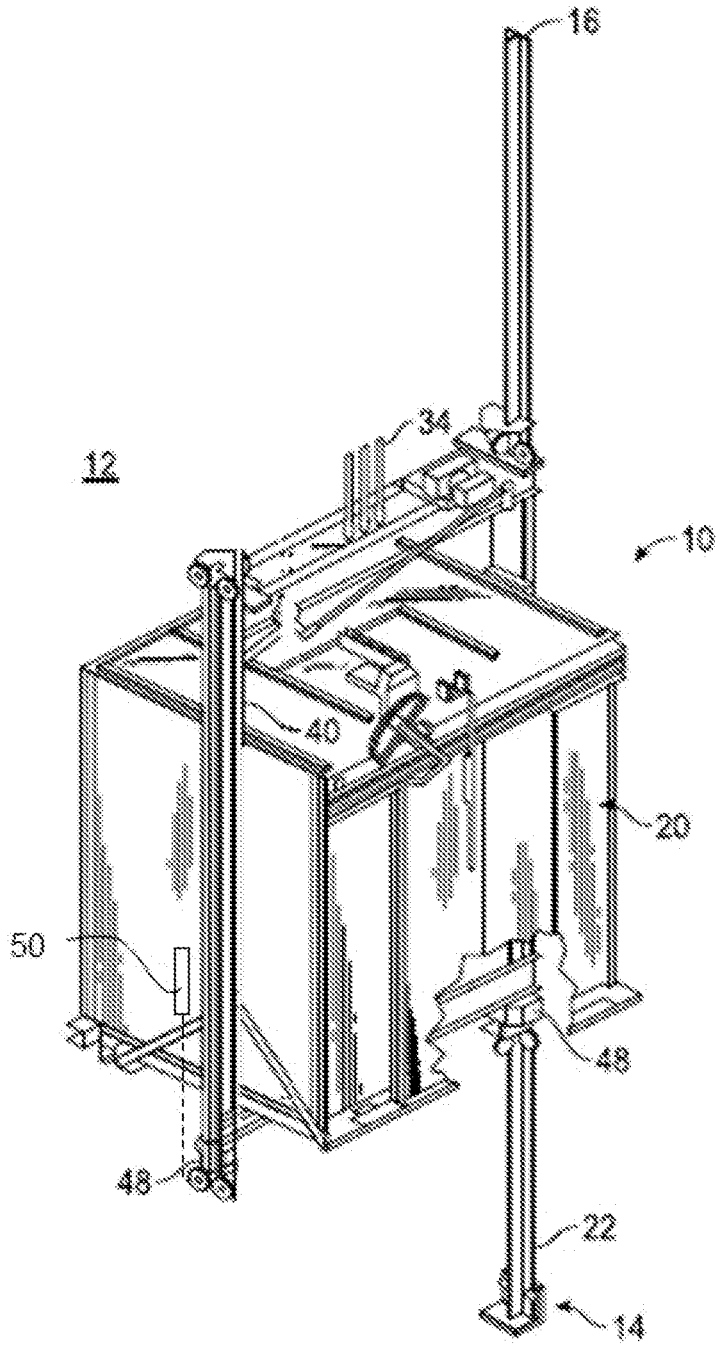
FIG. 1 is a schematic view of an example of a hoisting system including a braking device.
Figure 2:
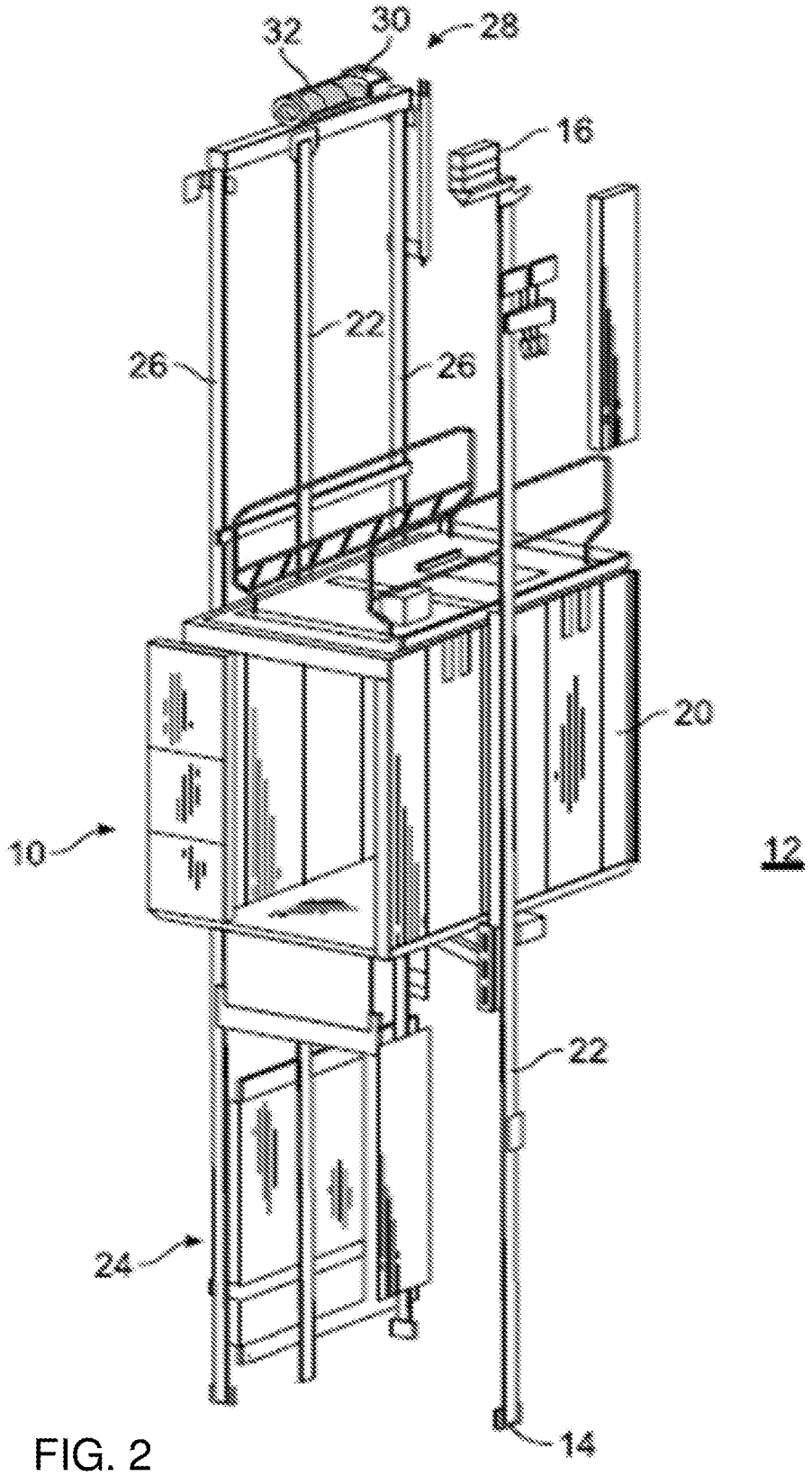
FIG. 2 is a perspective view of an exemplary elevator system.

Referring now to FIGS. 1 and 2, an example of a conventional elevator system 10 is illustrated including an elevator car 20 movable along car guide rails 22 in a known manner. In one example, a machine room-less elevator system 10 allows the elevator car 20 to move essentially along the entire length of a hoistway 12 between a lower end 14 of the hoistway and an upper end 16 of the hoistway 12. A drive system 28 moves the elevator car 20 in the hoistway 12. The drive system 28 may include a drive motor 30 and a drive sheave 32. The drive sheave 32 may be coupled to the drive motor 30 such that rotational output of the drive motor 30 is transmitted to the drive sheave 32. One or more tension members 34 connect the elevator car 20 to a counterweight 24 movable along counterweight guide rails 26. The tension members 34 may be belts, cables, ropes, or any other known element for coupling a car 20 and a counterweight 24. The rotational output of the drive motor 30 is transmitted to the elevator car 20 via the tension members 34 guided around the drive sheave 32.

The elevator car additionally includes a safety device 50 operably coupled to one or more safety brakes 48. In the event that the elevator car 20 moves too fast, the safety device 50 is configured to activate the safety brakes 48 shown diagrammatically in FIG. 1. In this example, the safety brakes 48 apply a braking force against the car guide rails 22 to prevent further movement of the elevator car 20. A variety of safety brakes 48 for this purpose are known. Connecting rods (not shown) may be arranged in a known manner above the car roof and/or below the car floor to synchronize the operation of the safety brakes 48 cooperating with respective car guide rails 22 disposed on both sides of the car 20. Although the safety device 50 as described herein is configured to brake movement of an elevator car 20 relative to a guide member 22, use of the safety device 50 in other applications is within the scope of the present disclosure.

Figure 3:
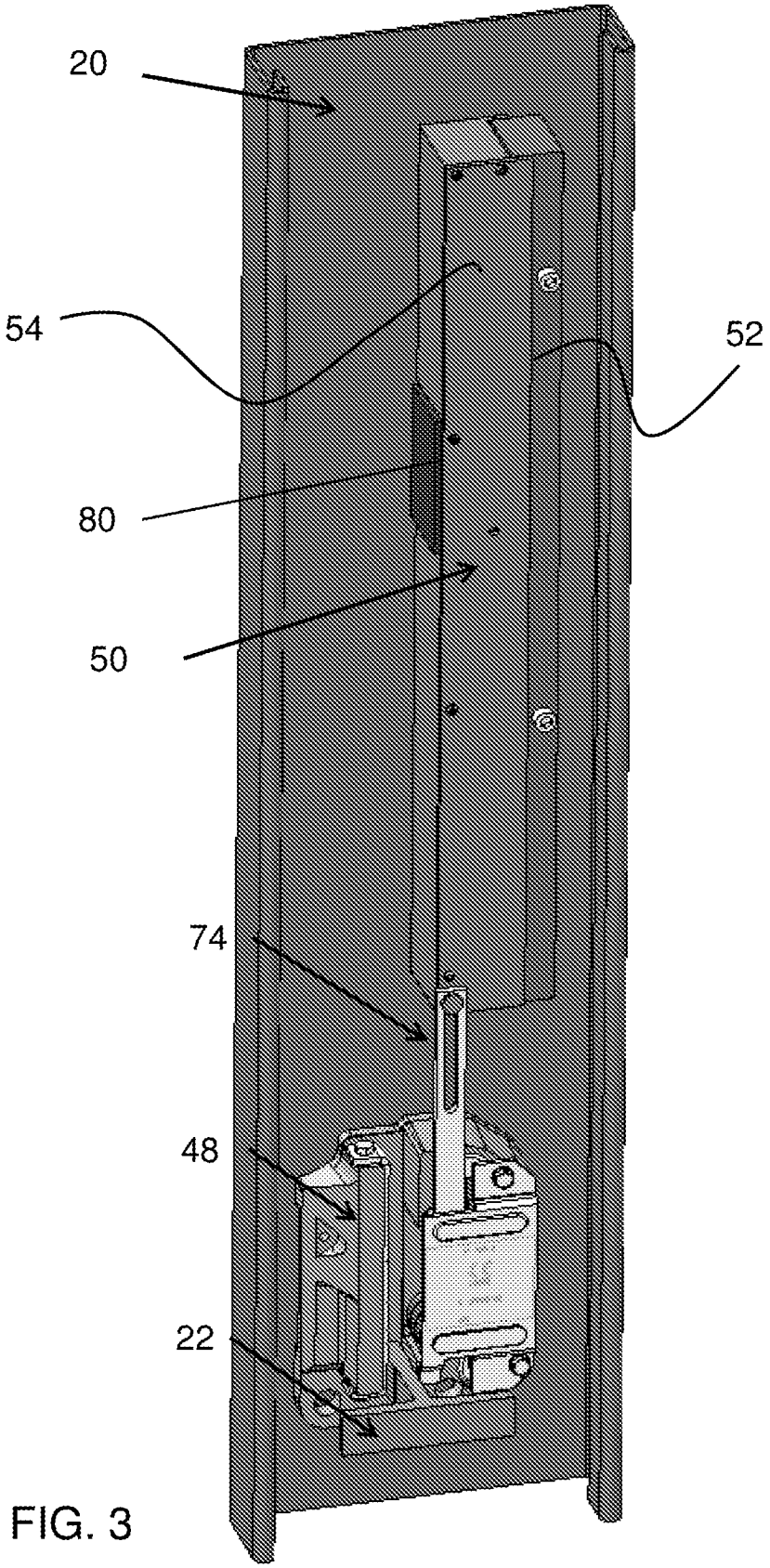
FIG. 3 is a perspective view of a safety device mounted to a portion of an elevator car according to an embodiment of the present disclosure.
Figure 4:
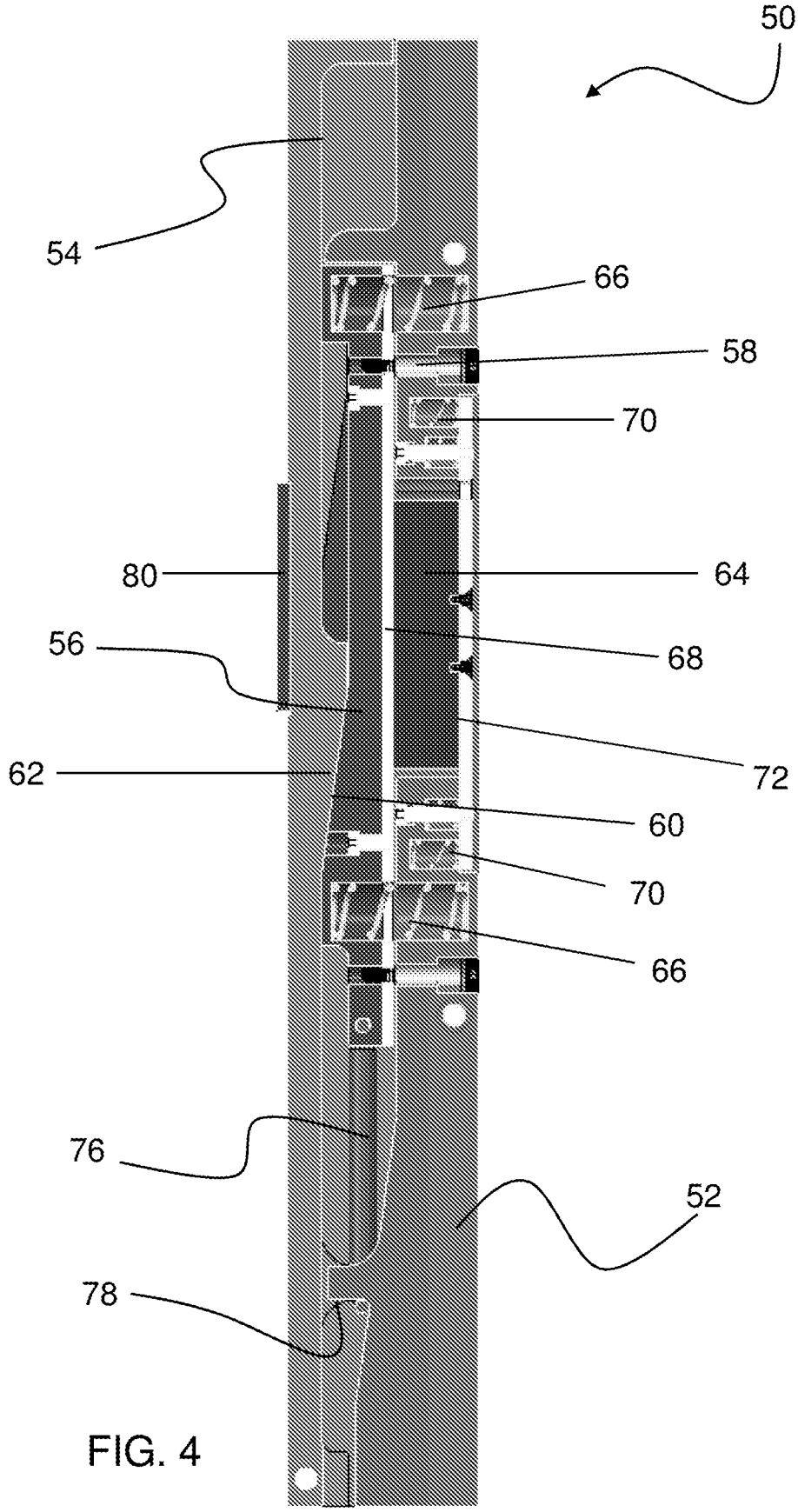
FIG. 4 is a cross-sectional view of the safety device according to an embodiment of the present disclosure.
Figure 5:
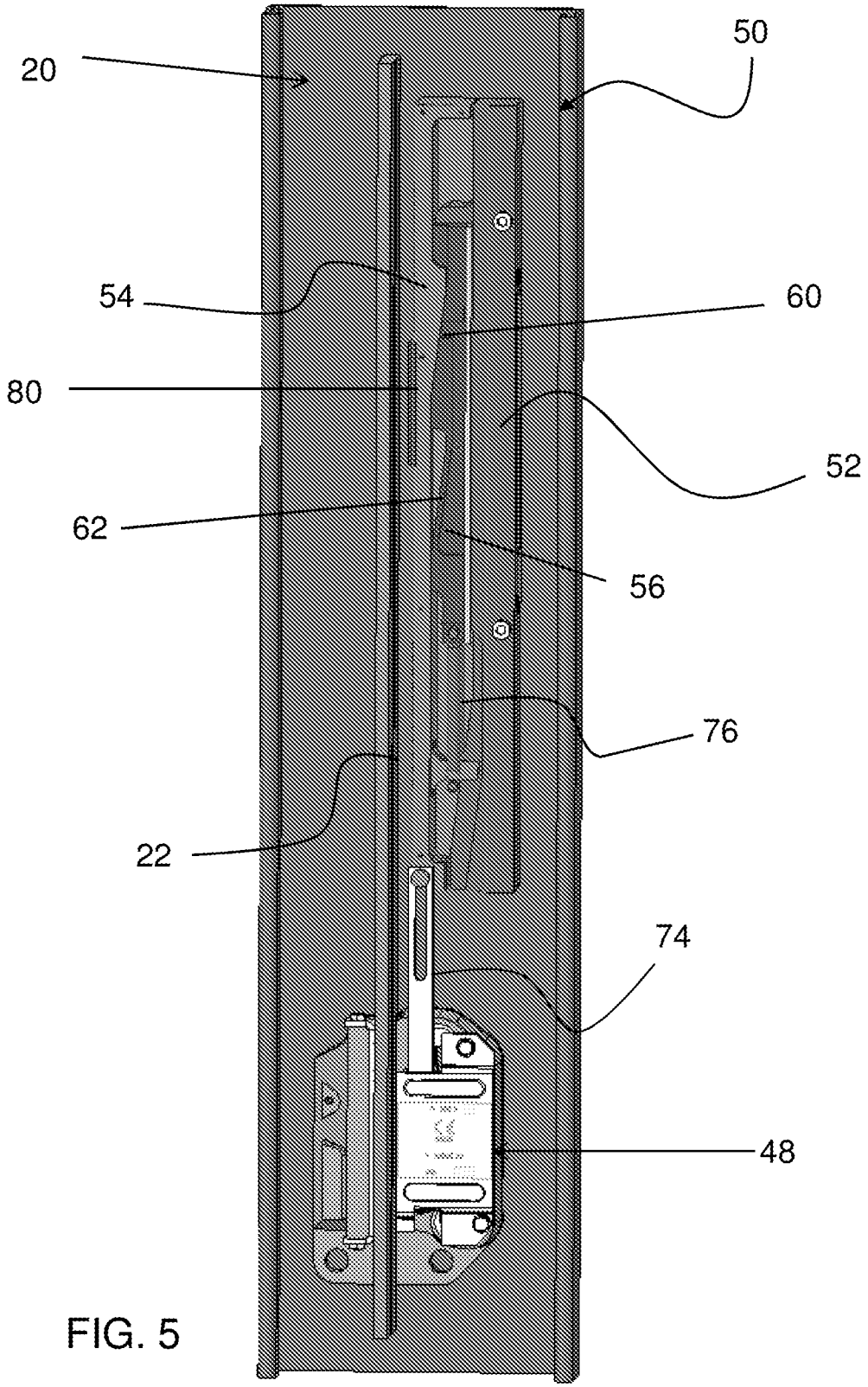
FIG. 5 is a side view of a safety device in a normal position according to an embodiment of the present disclosure.
Figure 6:
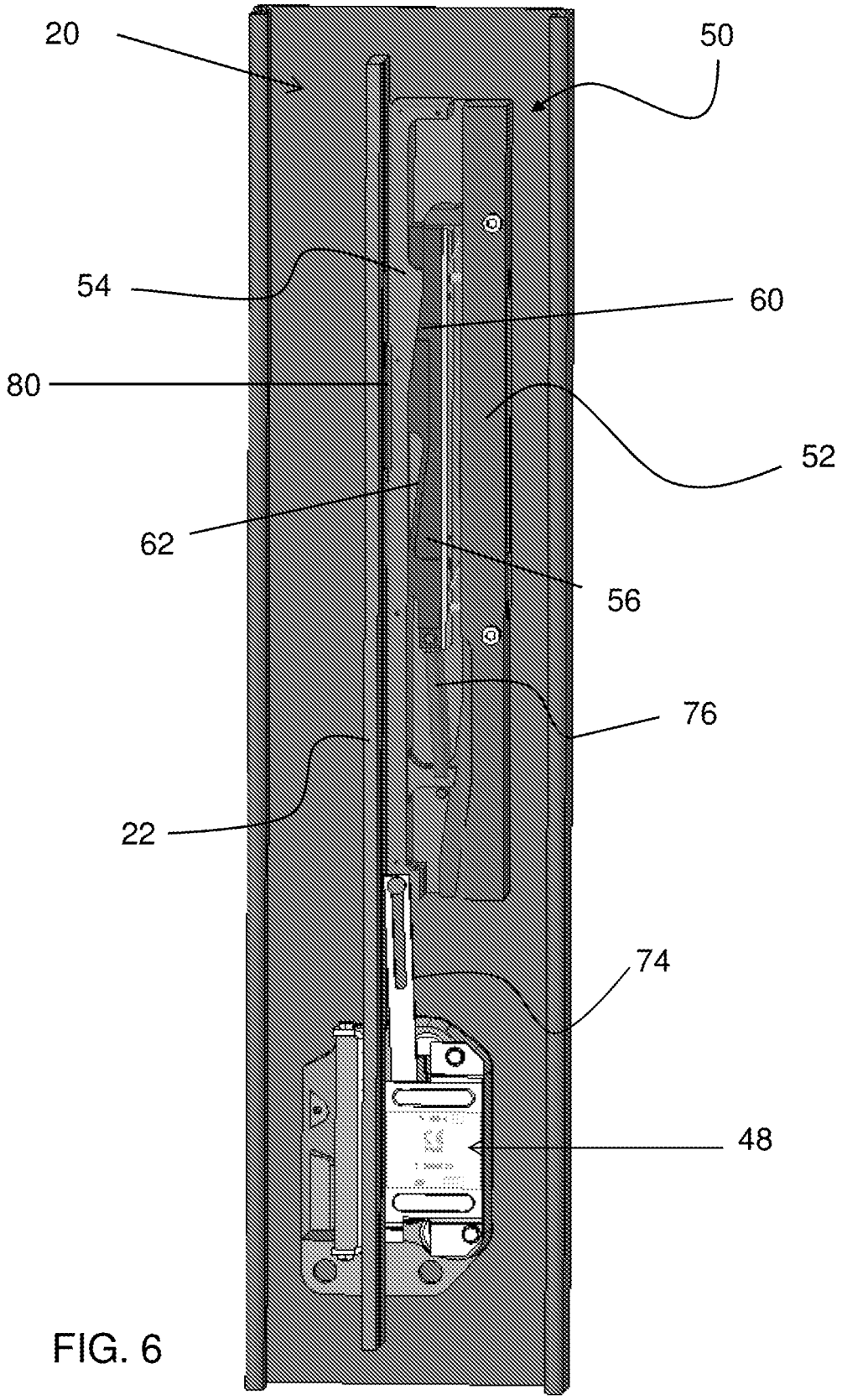
FIG. 6 is a side view of a safety device of FIG. 5 after detection of an over-speed condition according to an embodiment of the present disclosure.
Figure 7:
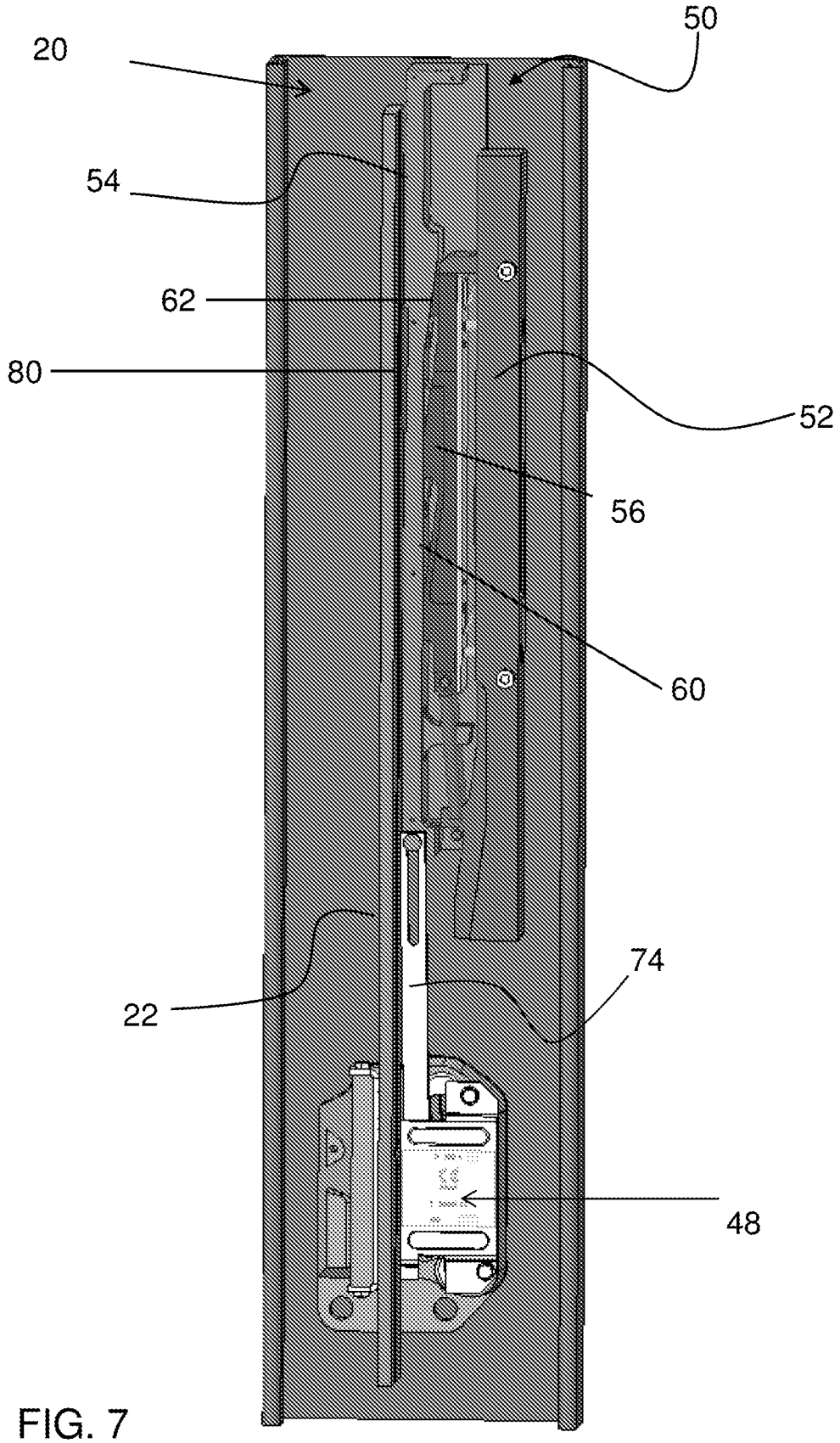
FIG. 7 is a side view of the safety device of FIG. 5 after activating a safety brake according to an embodiment of the present disclosure.

Referring now to FIGS. 3-5, the safety device 50 of the elevator system 10 is illustrated in more detail. Although only one safety device 50 is schematically illustrated in FIG. 1, the elevator system 10 may include a plurality of strategically mounted safety devices 50, for example adjacent each of the safety brakes 48. The safety device 50 includes a mounting frame 52 mounted to a portion of the car 20, such as an upright of the car frame for example, and a brake block 54 movable relative to the mounting frame 52. The brake block 54 is configured to move both laterally and vertically relative to the mounting frame 52. In the illustrated, non-limiting embodiment, the brake block 54 and the mounting frame 52 are generally complementary in shape such that when the brake block 54 is in a non-actuated position, for example during normal operation of the elevator system 10, the safety device 50 has a generally rectangular contour.

An inner block assembly 56 is positioned generally centrally between the brake block 54 and the mounting frame 52. At least one retaining member 58, such as a shoulder bolt, dowel, or rod for example, extends between the inner block assembly 56 and the mounting frame 52 to limit vertical, but not lateral movement of the inner block assembly 56 relative to the frame 52. The side of the inner block assembly 56 configured to contact the brake block 54 includes at least one sloped or ramp-like surface 60. The adjacent side of the brake block 54 is formed with a similarly angled surface 62 having a contour generally complementary to surface 60 of the inner block assembly 56.

An electromagnetic latch 64 is positioned within the mounting frame 52, adjacent the inner block assembly 56 and opposite the brake block 54. At least one first biasing mechanism 66, such as a coil spring for example, is positioned within a cavity formed in the mounting frame 52. An end of the at least one first biasing mechanism 66 is operably coupled to a second side 68 of the inner block assembly 56. In one embodiment, the second side 68 of the inner block assembly 56 arranged adjacent the electromagnetic latch 64 includes a magnetic material. In one embodiment, the magnetic material may be a separate component coupled to the inner block assembly 56, or alternatively, may be integrally formed therewith. At least one second biasing mechanism 70 is similarly located within the mounting frame 52 and configured to contact a plate 72 connected to the side of the electromagnetic latch 64 away from the inner block assembly 54.

As shown in FIG. 3, the safety device 50 is disposed generally vertically above a safety brake 48 such that a safety linkage 74 configured to activate the safety brake 48 extends between the safety brake 48 and a portion of the brake block 54. An additional biasing mechanism 76 (see FIG. 4) extends between a portion of the inner block assembly 56, such as a lower end thereof, and a portion of the brake block 54. In one embodiment, the biasing mechanism 76 is coupled to an arm 78 extending from horizontally and disposed vertically below the inner block assembly 56.

During travel of the elevator car 20 within the hoistway 12 at a normal speed, the magnetic portion of the inner block assembly 56 is attracted to and arranged in contact with the electromagnetic latch 64. In addition, the brake block 54 and the inner block assembly 56 are in contact such that the respective angled surface 62 and the sloped surface 60 are arranged in an overlapping configuration.

Figure 4A:
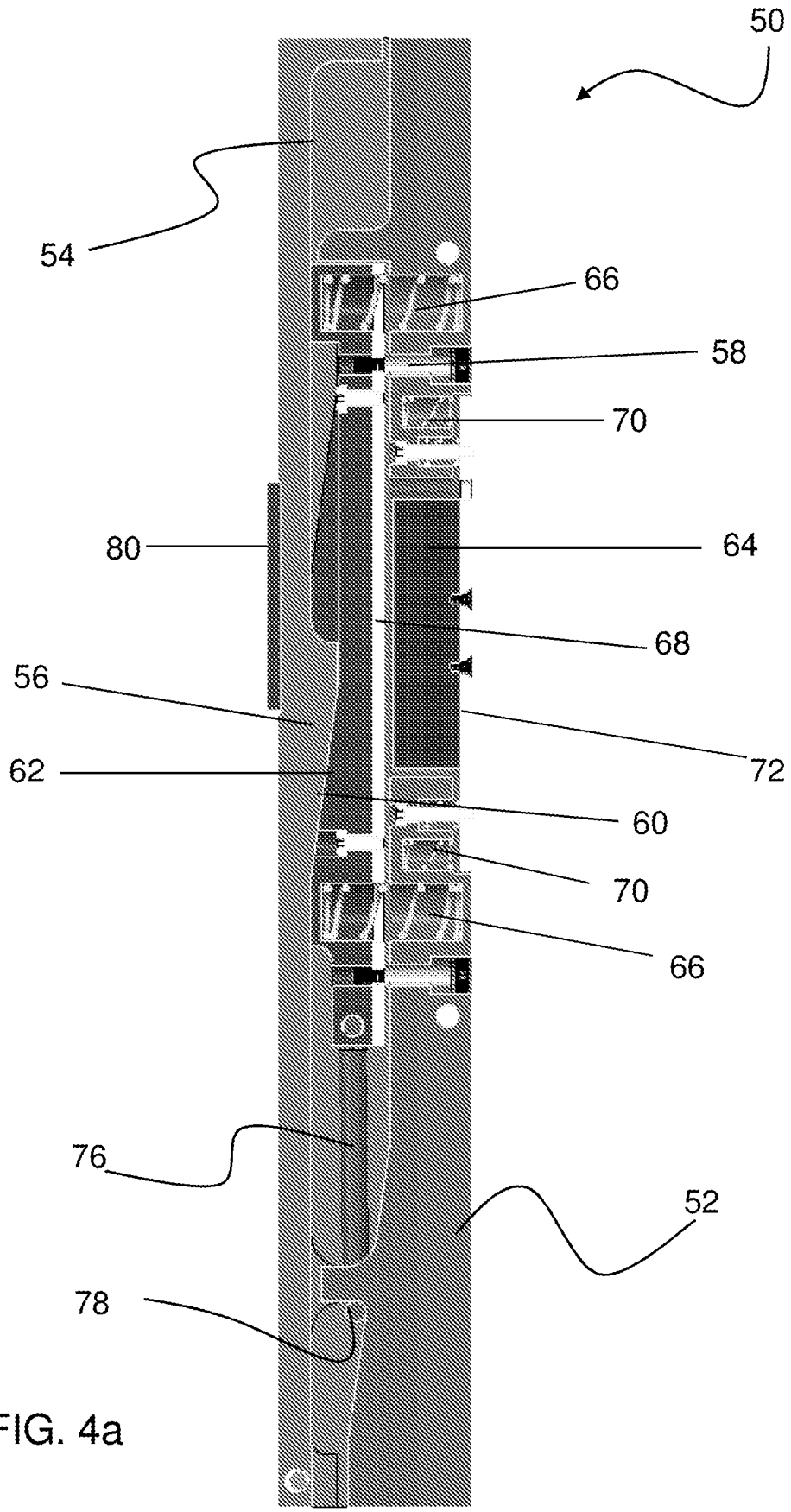
FIG. 4*a* is a cross-sectional view of the safety device after application of an electrical current to the electromagnetic latch according to an embodiment of the present disclosure.

Referring now to FIGS. 6-10, detection of an over-speed condition of the car 20 while travelling vertically downward, such as via an accelerometer or other sensor (not shown) for example, causes an electrical current to be applied to the electromagnetic latch 64. Application of electrical current to the electromagnetic latch 64 counteracts the magnetic force normally generated by the electromagnetic latch 64. With reference to FIG. 4*a*, in the absence of the magnetic force holding the latch 64 and the inner block assembly 56 together, the at least one second biasing mechanism 70 biases the electromagnetic latch 64 laterally in a direction away from the inner block assembly 56. Simultaneously, the at least one first biasing mechanism 66 biases the inner block assembly 56 and the brake block 54 laterally towards the adjacent guide rail (see FIG. 6).

A brake pad 80 is mounted to an exterior surface of the brake block 54, directly adjacent the guide rail 22. As a result of the lateral movement of the brake block 54 as the elevator car 20 is moving within the hoistway 12, the brake pad 80 contacts the guide rail 22. Friction generated between the brake pad 80 and the guide rail 22 as the car 20 is moving causes the brake block 54 to move vertically upward relative to the mounting frame 52 (see FIG. 7), thereby applying a force to the safety linkage 74 and an activating the safety brake 48 coupled thereto. Activation of the at least one safety brake 48 stops movement of the elevator car 20 relative to the guide rails 22.

Figure 8:
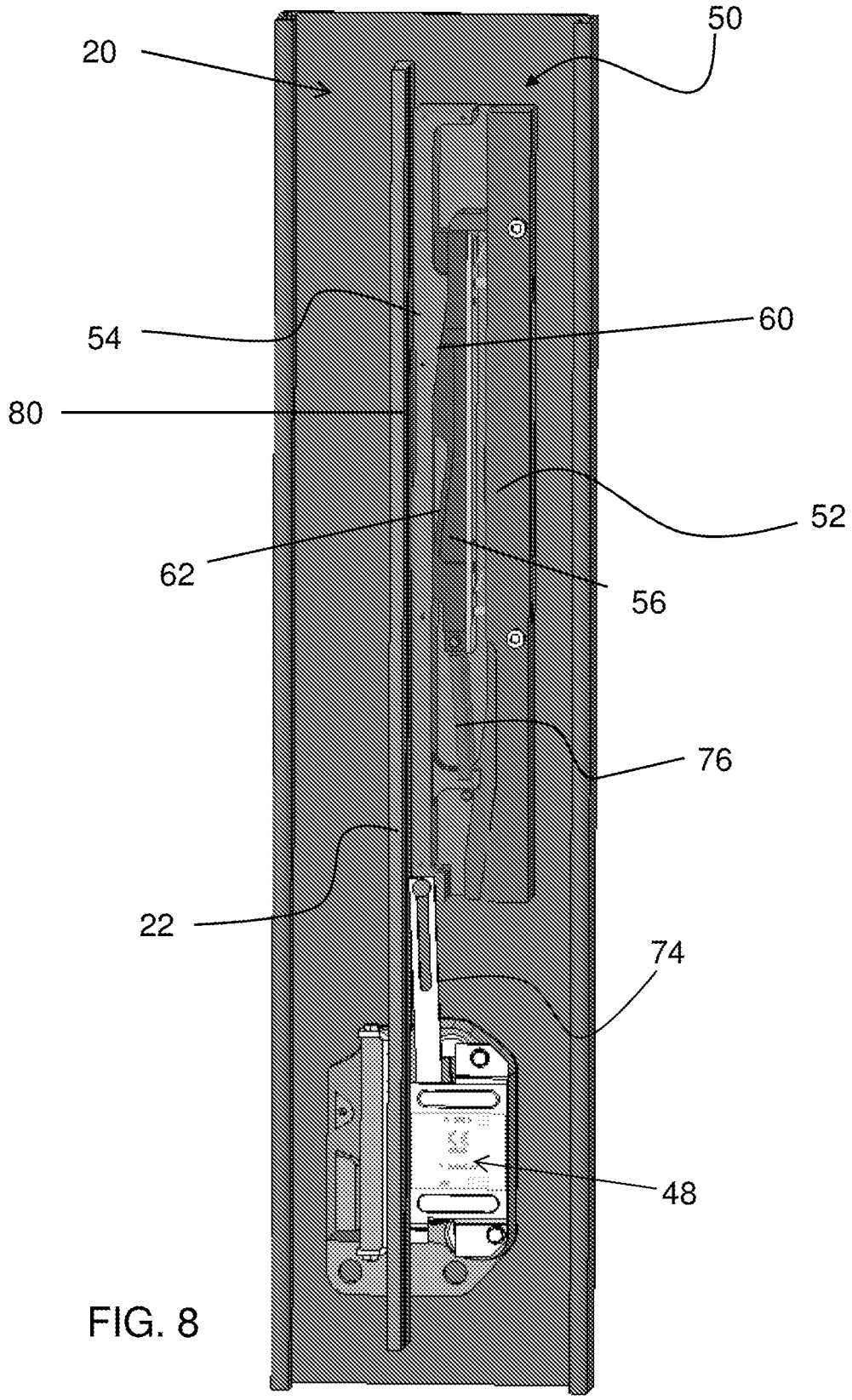
FIG. 8 is a side view of the safety device of FIG. 5 as the safety device is being reset according to an embodiment of the present disclosure.
Figure 9:
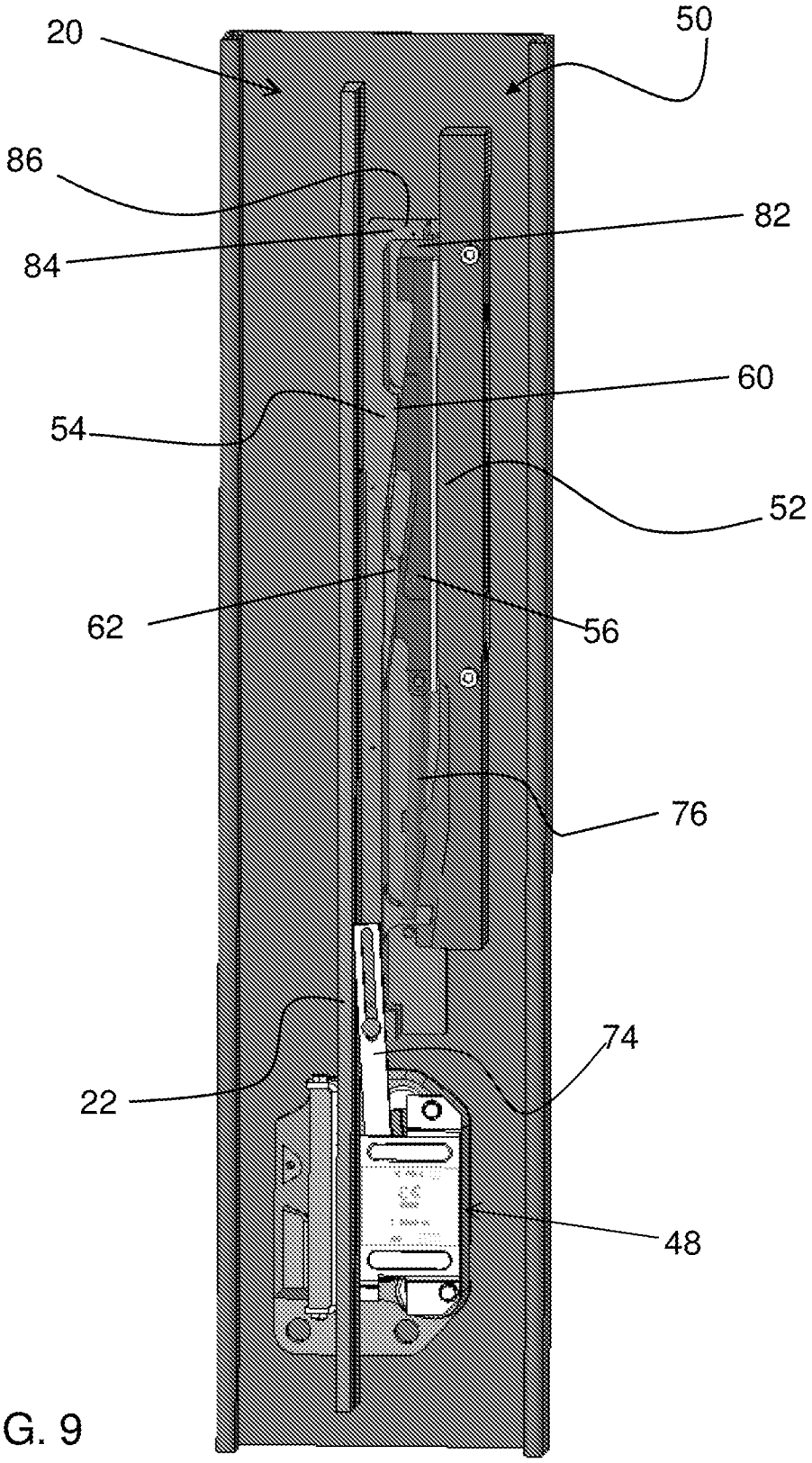
FIG. 9 is another side view of the safety device of FIG. 5 as the safety device is being reset according to an embodiment of the present disclosure.
Figure 10:
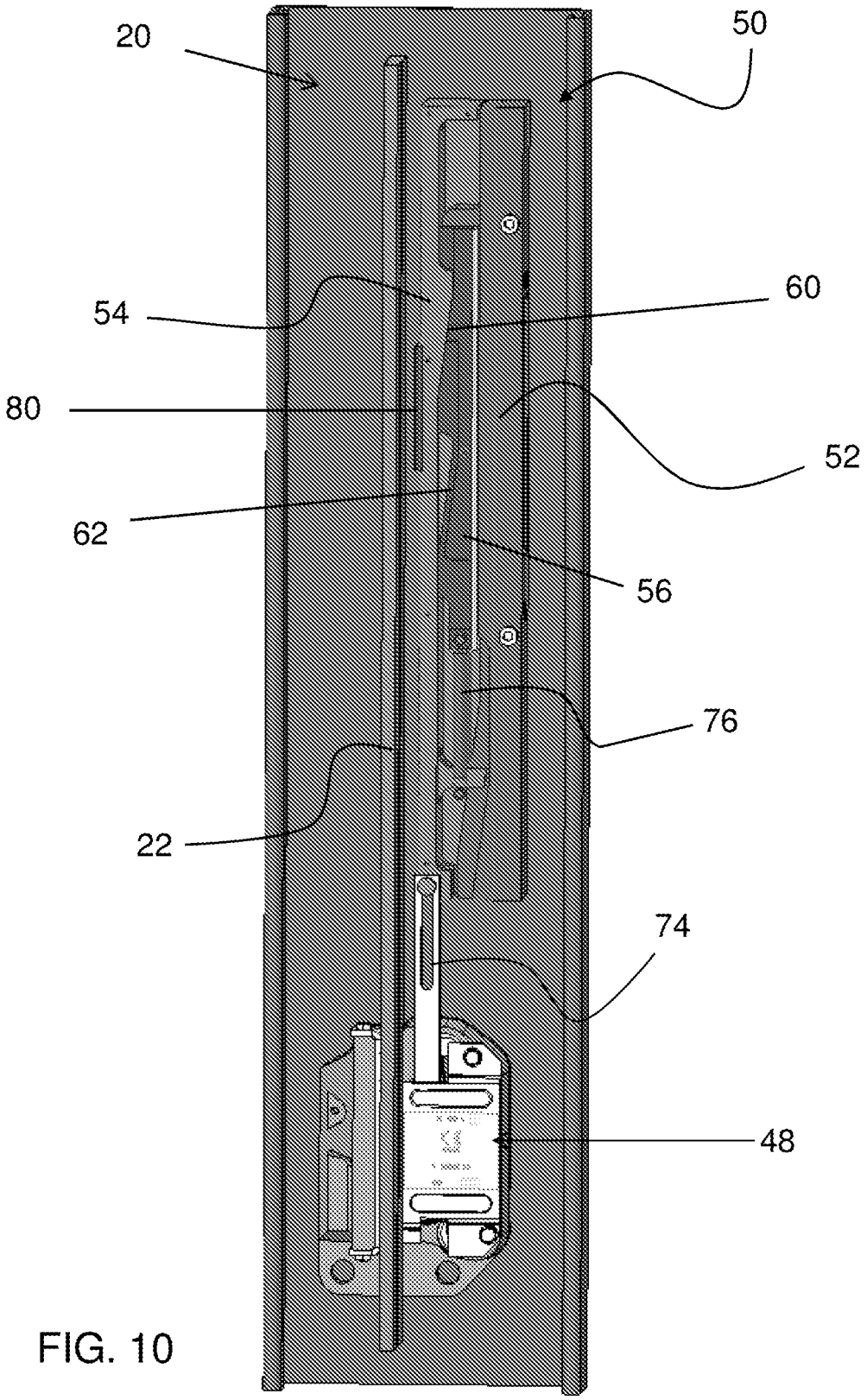
FIG. 10 is a side view of the safety device of FIG. 5 after being reset according to another embodiment of the present disclosure.

Motion of the elevator car 20 is used to reset the safety device 50. As illustrated in FIGS. 8-10, the elevator car 20 is driven vertically upwards, beyond the normal position shown in FIG. 8. The upward movement of the elevator car 20 causes the inner block assembly 56 to slidably contact the adjacent surface of the brake block 54. In one embodiment, illustrated in FIG. 9, the car 20 is driven vertically upward to a maximum where a horizontally extending arm 82 of the mounting frame 52 is in contact with a horizontally extending arm 84 arranged adjacent a first end 86 of the brake block 54. With reference to FIG. 9, as the inner block assembly 56 moves along the angled surface 62, the geometry of the angled surface 62 is configured to move the inner block assembly 56 laterally towards the electromagnetic latch 64, against the bias of the at least one first biasing mechanism 66. After the inner block assembly 56 is brought into proximity of the electromagnetic latch 64, energizing the electromagnetic latch 64 produces a force that overcomes the force of the at least one second biasing member 70 and brings the electromagnetic latch 64 into contact with the inner block assembly 56. After the inner block assembly 56 and the electromagnetic latch 64 are reengaged, upward motion of the car 20 permits the tension generated in biasing mechanism 76 to lift the brake block 54 vertically into the "normal position" where the respective angled surface 62 and the sloped surface 60 are arranged in contact in an overlapping configuration.

The safety device 50 described herein is configured to replace conventional over-speed systems which typically comprise a governor, governor rope, and tensioning device. As a result, the number of components and overall complexity of the elevator system 20 is reduced. The compact design of the safety device 50 provides greater flexibility with respect to hoistway layout and ensures compatibility with a variety of safety brakes 48.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A safety device configured to aid in braking movement of a hoisted object, comprising:

a mounting frame;

a brake block connected to the mounting frame, the brake block being movable both vertically and laterally relative to the mounting frame;

an inner block assembly disposed between the mounting frame and the brake block, the inner block assembly having a first sloped surface and the brake block having a second sloped surface complementary to and arranged in contact with the first sloped surface, the inner block assembly being movable relative to both the mounting frame and the brake block; and a safety brake separate from and operably coupled to the brake block by a linkage, the safety brake being operable to apply a braking force to an adjacent guide member to stop movement of the hoisted object, wherein upon detection of a predetermined condition, the brake block is configured to engage the adjacent guide member to actuate the safety brake.

2. The safety device according to claim 1, wherein the safety device is mounted to the hoisted object.

3. The safety device according to claim 1, wherein a brake pad is arranged at a portion of the brake block configured to engage the guide member.

4. The safety device according to claim 1, wherein friction generated between the brake block and the guide member causes the brake block to apply a force to the linkage to actuate the safety brake.

5. The safety device according to claim 1, wherein upon detection of the predetermined condition, the brake block is biased by at least one biasing mechanism towards the guide member.

6. The safety device according to claim 5, wherein the at least one biasing mechanism biases the brake block laterally toward with the guide member.

7. The safety device according to claim 6, wherein the at least one biasing mechanism biases the inner block assembly and the brake block towards the guide member.

8. The safety device according to claim 7, further comprising an electromagnetic latch housed within the mounting frame, the electromagnetic latch being configured to attract a magnetic portion of the inner block assembly.

9. The safety device according to claim 8, wherein upon detection of the predetermined condition, the inner block assembly is configured to decouple from the electromagnetic latch.

10. The safety device according to claim 1, wherein sliding engagement between the first surface and the second surface after detection of the predetermined condition is configured to drive the inner block assembly laterally towards the mounting frame.

11. The safety device according to claim 10, wherein a second biasing mechanism extends between the inner block assembly and the brake block, the second biasing mechanism being configured to move the brake block such that the first surface and the second surface are aligned.

12. A method of actuating a safety brake of an elevator car, comprising:

providing a safety device including;

a mountain frame;

a brake block connected to the mounting frame, the brake block being moveable both vertically and laterally relative to the mounting frame;

an inner block assembly disposed between the mounting frame and the brake block, the inner block assembly having a first sloped surface and the brake block having a second sloped surface complementary to and arranged in contact with the first sloped surface, the inner block assembly being movable relative to both the mounting frame and the brake block; and a safety brake seperate from and operably coupled to the brake block by a linkage, the safety brake being operable to apply a braking force to an adjacent guide member to stop movement of the hoisted object;

detecting an over-speed condition;

moving the brake blockinto engagement with a guide member; and applying a force to the safety brake via the brake block such that the safety brake engages the guide member to stop movement of the elevator car.

13. The method of claim 12, wherein engagement between the brake block and the guide member causes the brake block to move vertically relative to the mounting frame.

14. The method of claim 13, wherein vertical movement of the brake block applies the force to the safety brake.

15. The method of claim 14, wherein the safety device includes an electromagnetic latch and the brake block moves into engagement with the guide member upon application of an electrical current to the electromagnetic latch.

16. The method of claim 15, further comprising resetting the safety device.

17. The method of claim 16, wherein resetting the safety device is accomplished by moving an elevator to which the safety device is mounted.

* * * * *